US012305250B2

(12) United States Patent
Hong

(10) Patent No.: US 12,305,250 B2
(45) Date of Patent: May 20, 2025

(54) STEEL PLATE FOR PRESSURE VESSEL WITH EXCELLENT CRYOGENIC LATERAL EXPANSION AND MANUFACTURING METHOD THEREFOR

(71) Applicant: POSCO, Pohang-si (KR)

(72) Inventor: Soon-Taik Hong, Pohang-si (KR)

(73) Assignee: POSCO, Pohang-si (KR)

( * ) Notice: Subject to any disclaimer, the term of this patent is extended or adjusted under 35 U.S.C. 154(b) by 515 days.

(21) Appl. No.: 17/639,705

(22) PCT Filed: Aug. 25, 2020

(86) PCT No.: PCT/KR2020/011278
§ 371 (c)(1),
(2) Date: Mar. 2, 2022

(87) PCT Pub. No.: WO2021/045425
PCT Pub. Date: Mar. 11, 2021

(65) Prior Publication Data

US 2022/0290266 A1 Sep. 15, 2022

(30) Foreign Application Priority Data

Sep. 3, 2019 (KR) ..... 10-2019-0109135

(51) Int. Cl.

| | |
|---|---|
| ***C21D 8/02*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |

(52) U.S. Cl.
CPC ..... *C21D 8/0263* (2013.01); *C21D 6/001* (2013.01); *C21D 6/005* (2013.01); *C21D 6/008* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C21D 2211/001* (2013.01); *C21D 2211/002* (2013.01); *C21D 2211/008* (2013.01)

(58) Field of Classification Search
None
See application file for complete search history.

(56) References Cited

U.S. PATENT DOCUMENTS

| | | | | |
|---|---|---|---|---|
| 6,517,955 | B1 * | 2/2003 | Takada | C22C 38/04 148/648 |
| 2013/0098514 | A1 | 4/2013 | Furuya et al. | |
| 2015/0147222 | A1 | 5/2015 | Miura et al. | |
| 2018/0371567 | A1 | 12/2018 | Hong | |
| 2018/0371568 | A1 | 12/2018 | Hong | |
| 2020/0071798 | A1 | 3/2020 | Hong | |

FOREIGN PATENT DOCUMENTS

| | | | | |
|---|---|---|---|---|
| EP | 1942203 | A1 | 7/2008 | |
| EP | 2889391 | A1 | 7/2015 | |
| EP | 2933347 | A1 * | 10/2015 | C21D 6/00 |
| JP | S5696052 | A | 8/1981 | |
| JP | S5696053 | A | 8/1981 | |
| JP | H07-109544 | A | 4/1995 | |
| JP | 2017-160512 | A | 9/2017 | |
| KR | 10-2004-0054198 | A | 6/2004 | |
| KR | 20040054198 | A * | 6/2004 | |
| KR | 10-0441413 | B1 | 7/2004 | |
| KR | 10-2008-0038226 | A | 5/2008 | |
| KR | 10-0833071 | B1 | 5/2008 | |
| KR | 10-2010-0076728 | A | 7/2010 | |
| KR | 10-2012-0011289 | A | 2/2012 | |
| KR | 10-2013-0103422 | A | 9/2013 | |
| KR | 10-2013-0116202 | A | 10/2013 | |
| KR | 10-2015-0029754 | A | 3/2015 | |
| KR | 10-1702480 | B1 | 2/2017 | |
| KR | 10-2017-0073015 | A | 6/2017 | |
| KR | 10-2018-0071683 | A | 6/2018 | |
| WO | 2012/005330 | A1 | 1/2012 | |
| WO | 2018/101447 | A1 | 6/2018 | |
| WO | 2019/098483 | A1 | 5/2019 | |

OTHER PUBLICATIONS

International Search Report dated Dec. 1, 2020 issued in International Patent Application No. PCT/KR2020/011278 (with English translation).
Extended European Search Report dated Apr. 14, 2023 issued in European Patent Application No. 20861064.2.
Japanese Office Action dated Apr. 18, 2023 issued in Japanese Patent Application No. 2022-514244.

* cited by examiner

*Primary Examiner* — Jenny R Wu

(74) *Attorney, Agent, or Firm* — Morgan Lewis & Bockius LLP

(57) ABSTRACT

Provided is a steel plate for a pressure vessel with excellent cryogenic lateral expansion and a manufacturing method therefor.

The steel plate for a pressure vessel according to the present invention comprises, by wt %, 0.05 to 0.15% of C, 0.20 to 0.40% of Si, 0.3 to 0.6% of Mn, 0.015% or less of P, 0.015% or less of S, 0.02 to 0.10% of Al, 4.5 to 5.5% of Ni, 0.2 to 0.4% of Mo, 0.001 to 0.15% of Pd, with a remainder of Fe and inevitable impurities, and the steel plate has a steel microstructure comprising, by area fraction, 0.5 to 5.0% of retained austenite, 25 to 85% of tempered bainite, and a remainder of tempered martensite.

4 Claims, No Drawings

STEEL PLATE FOR PRESSURE VESSEL WITH EXCELLENT CRYOGENIC LATERAL EXPANSION AND MANUFACTURING METHOD THEREFOR

CROSS-REFERENCE OF RELATED APPLICATIONS

This application is the U.S. National Phase under 35 U.S.C. § 371 of International Patent Application No. PCT/KR2020/011278, filed on Aug. 25, 2020, which in turn claims the benefit of Korean Application No. 10-2019-0109135, filed on Sep. 3, 2019, the entire disclosures of which applications are incorporated by reference herein.

TECHNICAL FIELD

The present disclosure relates to a thick steel plate used for low-temperature pressure vessels, ships, storage tanks, structure steel, and the like and a manufacturing method therefor, and more particularly, to a steel plate for a low-temperature pressure vessel with a tensile strength of 700 MPa grade with excellent lateral cryogenic expansion characteristics and a manufacturing method therefor.

BACKGROUND ART

A high-strength thick steel plate material for low-temperature use is comprised of a three-phase mixed structure including a retained austenite structure, a tempered martensite structure, and a tempered bainite structure, and needs to be able to be used as a structural material for cryogenic use itself during construction, and thus, needs to have excellent strength and lateral cryogenic expansion characteristics.

Meanwhile, high-strength hot-rolled steel manufactured through typical normalizing treatment may have a mixed structure of ferrite and pearlite. An example of the related art therefor may include the invention described in Patent Document 1. The invention described in Patent Document 1 proposes 500 MPa grade high-strength steel for LPG comprised of, by wt %, 0.08 to 0.15% of C, 0.2 to 0.3% of Si, 0.5 to 1.2% of Mn, 0.01 to 0.02% of P, 0.004 to 0.006% of S, Ti exceeding 0% and less than or equal to 0.01%, 0.05 to 0.1% of Mo, 3.0 to 5.0% of Ni, and a remainder of Fe, and other inevitable impurities, in which Ni and Mo are added in the steel composition.

However, since the invention described in the above Patent Document 1 is steel manufactured through the typical normalizing treatment, there may be a problem that the lateral cryogenic expansion characteristics of the steel are not sufficient even if Ni is added. Therefore, in the high-strength thick steel plate used for low-temperature pressure vessels, ships, storage tanks, structure steel, and the like, there is a need to develop a high-strength steel with excellent lateral cryogenic expansion characteristics.

RELATED ART DOCUMENT

Patent Document (Patent Document 1) Korean Patent Laid-Open Publication No. 2012-0011289

DISCLOSURE

Technical Problem

An aspect of the present disclosure is to provide a steel plate for a low-temperature pressure vessel capable of securing a tensile strength of 700 MPa grade manufactured by controlling a microstructure of the steel plate to have a three-phase mixed microstructure including a retained austenite, a tempered martensite, and a tempered bainite through controlling a cooling and heat treatment and a manufacturing method therefor.

However, problems to be solved by the present disclosure are not limited to the above-mentioned aspects. That is, other aspects not described herein may be obviously understood by those skilled in the art from the following specification.

Technical Solution

In an aspect of the present disclosure, a steel plate for a low-temperature pressure vessel with excellent strength and lateral cryogenic expansion characteristics contains:

by wt %, 0.05 to 0.15% of C, 0.20 to 0.40% of Si, 0.3 to 0.6% of Mn, 0.015% or less of P, 0.015% or less of S, 0.02 to 0.10% of Al, 4.5 to 5.5% of Ni, 0.2 to 0.4% of Mo, 0.001 to 0.15% of Pd, with a remainder of Fe and inevitable impurities, in which a steel microstructure comprises, by area fraction, 0.5 to 5.0% of retained austenite, 25 to 85% of tempered bainite, and a remainder of tempered martensite.

In another aspect of the present disclosure, a method of manufacturing a steep plate for a low-temperature pressure vessel with excellent strength and lateral cryogenic expansion characteristics comprises the processes of:

reheating steel slab comprising, by wt %, 0.05 to 0.15% of C, 0.20 to 0.40% of Si, 0.3 to 0.6% of Mn, 0.015% or less of P, 0.015% or less of S, 0.02 to 0.10% of Al, 4.5 to 5.5% of Ni, 0.2 to 0.4% of Mo, 0.001 to 0.15% of Pd, with a remainder of Fe and inevitable impurities, at 1050 to 1250° C.;

performing a hot rolling process of manufacturing a hot-rolled steel plate by hot-rolling the reheated steel slab at a reduction ratio of 5 to 30% per pass and terminating the hot rolling at a temperature of 800° C. or higher;

air-cooling the manufactured hot-rolled steel plate, heating the air-cooled steel plate in a temperature range of 850 to 920° C. for {2.4×t+(10 to 30)} minutes [where t means a thickness (mm) of a steel], and then water-cooling the manufactured hot-rolled steel plate to 150° C. or lower;

performing an intermediate heat treatment for the water-cooled steel sheet at 690 to 760° C. for {2.4×t+(10 to 30)} minutes [where t is the thickness (mm) of the steel], and then water-cooling the water-cooled steel sheet to 150° C. or lower; and tempering the water-cooled steel sheet for {2.4×t+(10 to 30)} minutes [where t is the thickness (mm) of the steel] in a range of 600 to 660° C.

The steel microstructure obtained in the tempering may have a microstructure comprising, by area fraction, 0.5 to 5.0% of retained austenite, 25 to 85% of tempered bainite, and a remainder of tempered martensite.

Advantageous Effects

As set forth above, it is possible to effectively provide a steel plate for a low-temperature pressure vessel with excellent strength and lateral expansion characteristics that may stably be used at a low temperature of about −150° C. while satisfying a tensile strength of 700 MPa grade.

BEST MODE

Hereinafter, the present disclosure will be described in detail.

First, a steel plate for a low-temperature pressure vessel with excellent tensile strength and lateral expansion characteristics of the present disclosure will be described.

The steel plate of the present disclosure is comprised of, by wt %, 0.05 to 0.15% of C, 0.20 to 0.40% of Si, 0.3 to 0.6% of Mn, 0.015% or less of P, 0.015% or less of S, 0.02 to 0.10% of Al, 4.5 to 5.5% of Ni, 0.2 to 0.4% of Mo, 0.001 to 0.15% of Pd, with a remainder of Fe and inevitable impurities, and the specific components of the steel plate and the reasons for restriction of those components are as follows. Meanwhile, in the following, means "wt %" unless otherwise specified.

C: 0.05 to 0.15%

For the steel plate of the present disclosure, it is preferable to add C in the range of 0.05 to 0.15%. When the content of C is less than 0.05%, strength of a matrix itself is lowered, and when the content of C exceeds 0.15%, weldability of the steel plate is greatly impaired. More preferably, the content of C is limited to the range of 0.08 to 0.10%.

Si: 0.20 to 0.40%

Si is a component added for a deoxidation effect, a solid solution strengthening effect, and an impact transition temperature raising effect, and is preferably added 0.20% or more in order to achieve such an additive effect. However, when Si is added in excess of 0.40%, the weldability deteriorates and an oxide film is severely formed on a surface of the steel plate, so it is preferable to limit the addition amount of Si to 0.20 to 0.40%. More preferably, the content of Si is limited to the range of 0.25 to 0.30%.

Mn: 0.3 to 0.6%

Mn forms MnS together with S, which is a elongated non-metallic inclusion, to reduce room temperature elongation ratio and low temperature toughness, so it is preferable that Mn is managed to be 0.6% or less. However, since it may be difficult to secure adequate strength when Mn is less than 0.3% due to the features of the components of the present disclosure, it is preferable to limit the amount of Mn to 0.3 to 0.6%. More preferably, the content of Mn is limited to the range of 0.5 to 0.6%.

Al: 0.02 to 0.10%

Al is one of strong deoxidizers during a steelmaking process along with Si. When Al is added less than 0.02%, the effect of the addition is insignificant, and when Al is added in excess of 0.10%, the manufacturing costs increase. As a result, it is preferable to limit the content of Al to 0.02 to 0.10%.

P: 0.015% or Less

P is an element that harms low-temperature toughness, but it takes excessive costs to remove P during the steelmaking process, so it is preferable to manage P within the range of 0.015% or less.

S: 0.015% or less

S is also an element that adversely affects low-temperature toughness along with P, but similar to P, it may take excessive costs to remove S during the steelmaking process, so it is appropriate to manage S within the range of 0.015% or less.

Ni: 4.5 to 5.5%

Ni is the most effective element for improving low-temperature toughness. However, when Ni is added in an amount of less than 4.5%, low-temperature toughness deteriorates, and when Ni is added in excess of 5.5%, manufacturing costs increase, so it is preferable to add Ni within the range of 4.5 to 5.5%. More preferably, the content of Ni is limited to the range of 4.8 to 5.2%.

Mo: 0.2 to 0.4%

Mo is a very important element for hardenability and strength improvement, and when Mo is added in an amount of less than 0.2%, the effect of the addition may not be expected, and when Mo exceeds 0.4%, Mo is expensive and uneconomical, so it is preferable to limit Mo to 0.4% or less. More preferably, the content of Mo is limited to the range of 0.25 to 0.30%.

Pd: 0.001 to 0.15%

In the present disclosure, Pd is a metal with good ductility and malleability, and is an important element for increasing lateral expansion characteristics. However, when Pd is added in amount of less than 0.001%, the effect of the addition may not be expected, and since Pd is an expensive element, when an upper limit of the addition amount of Pd exceeds 0.15%, Pd is expensive and uneconomical, so it is preferable to limit Pd to 0.15% or less. More preferably, the content of Pd is limited to the range of 0.05 to 0.10%.

On the other hand, the steel plate of the present disclosure has a steel microstructure comprising, by area %, 0.5 to 5.0% of retained austenite, 25 to 85% of tempered bainite, and a remainder of tempered martensite.

When the tempered bainite fraction is less than 25%, the amount of tempered martensite may become excessive and the low-temperature toughness of the steel plate may deteriorate. On the other hand, when the tempered bainite fraction exceeds 85%, it may be difficult to secure the target strength of the steel plate.

When the retained austenite area fraction is 0.5% or less, the low-temperature toughness, that is, the lateral expansion characteristics may be impaired, and when the retained austenite area fraction exceeds 5.0%, the strength decreases, so it is preferable to limit the retained austenite area fraction to the range of 0.5 to 5.0%.

The steel plate of the present disclosure, which has the above-described steel composition components and microstructure, may effectively maintain a tensile strength of 700 MPa grade and have excellent lateral expansion characteristics even at a cryogenic temperature.

Next, a method for manufacturing a steel plate of the present disclosure will be described.

The method of manufacturing a steel plate of the present disclosure comprises the processes of: reheating the steel slab of the above-described alloy composition at 1050 to 1250° C., performing a hot rolling process of manufacturing a hot-rolled steel plate by hot-rolling the reheated steel slab at a reduction ratio of 5 to 30% per pass and terminating the hot rolling at a temperature of 800° C. or higher, air-cooling the manufactured hot-rolled steel plate, heating the air-cooled steel plate in a temperature range of 850 to 920° C., and then water-cooling the manufactured hot-rolled steel plate to 150° C. or lower, performing an intermediate heat treatment for the water-cooled steel sheet at 690 to 760° C., and then water-cooling the water-cooled steel sheet to 150° C. or lower, and tempering the water-cooled steel sheet in a range of 600 to 660° C. That is, the steel for a pressure vessel of the present disclosure may be manufactured through the [reheating—hot rolling and cooling—heat treatment and cooling—tempering] processes of the steel slab satisfying the alloy composition described above. Hereinafter, each of the process conditions will be described in detail.

[Reheating Steel Slab]

First, it is preferable to reheat the steel slab satisfying the above-described alloy composition to a temperature range of 1050 to 1250° C. In this case, when the reheating temperature is less than 1050° C., it may be difficult to dissolve solute atoms, whereas, when the reheating temperature exceeds 1250° C., an austenite crystal grain size becomes too coarse, which may not be preferable because of impairing physical properties of the steel.

[Hot Rolling and Cooling]

Next, in the present disclosure, a hot rolling process of manufacturing a hot-rolled steel plate is performed by hot-rolling the reheated steel slab at a reduction ratio of 5 to 30% per pass and terminating the hot rolling at a temperature of 800° C. or higher.

When the reduction ratio per pass during the hot rolling is less than 5%, there is a problem in that the manufacturing costs increase due to the decrease in rolling productivity, whereas, when the reduction ratio per pass exceeds 30%, a load is generated on a rolling mill, which may not be preferable because of having a fatal adverse effect on the equipment. It is preferable to terminate rolling at a temperature of 800° C. or higher. This is because the rolling to a temperature of 800° C. or lower may cause a load on the rolling mill. The manufactured hot-rolled steel plate is air-cooled.

[Heat Treatment]

Next, in the present disclosure, the air-cooled hot-rolled steel plate is heated for {2.4×t+(10 to 30)} minutes [where t is the thickness (mm) of the steel] at a temperature range of 850 to 920° C. and water-cooled to 150° C. or lower.

When the heating temperature before water cooling is less than 850° C., austenitization is not made, and when heated to a temperature exceeding 920° C., the crystal grain size is too coarse, which may impair toughness.

It is preferable to heat-treat the rolled steel plate at a certain temperature for a certain period of time as described above. Specifically, the air-cooled hot-rolled steel plate is heated for {2.4×t+(10 to 30)} minutes [where t is the thickness (mm) of the steel] in a temperature range of 850 to 920° C., and water-cooled to 150° C. or lower.

[Intermediate Heat Treatment]

In the present disclosure, the water-cooled steel plate is subjected to the intermediate heat treatment held for {(2.4×t)+(10 to 30)} minutes in a temperature range of 690 to 760° C. (where t is the thickness of the steel (unit mm)), and then cooled with water to 150° C. or lower.

When the temperature during the heat treatment is less than 690° C., it may be difficult to re-dissolve solid solute elements, so it may be difficult to secure the target strength, whereas, when the temperature exceeds 760°, there is a risk that crystal grain growth may occur to impair the low-temperature toughness.

In addition, when the holding time during the heat treatment in the above-described temperature range is less than {(2.4×t)+10} minutes, it may be difficult to homogenize the structure, whereas, when the holding time exceeds {(2.4×t)+30} minutes, it is not preferable because of impairing productivity.

[Tempering]

Next, in the present disclosure, the cooled hot-rolled steel plate is tempered for {2.4×t+(10 to 30)} minutes [where t is the thickness (mm) of the steel] in the range of 600 to 670° C. When the temperature during the tempering treatment is less than 600° C., it may be difficult to secure the target strength due to the difficulty in precipitation of fine precipitates, and when the temperature exceeds 670° C., there is a risk that the growth of precipitates may occur to impair the strength and low-temperature toughness.

In addition, when the holding time during the tempering treatment in the above-described temperature range is less than {(2.4×t)+10} minutes, it may be difficult to homogenize the structure, whereas, when the holding time exceeds {(2.4×t)+30} minutes, it is not preferable because of impairing productivity.

On the other hand, by the tempering process, the steel plate for a low-temperature pressure vessel with excellent tensile strength and lateral expansion characteristics according to the present disclosure having a steel microstructure containing, by area %, 0.5 to 5.0% of retained austenite, 25 to 85% of tempered bainite and a remainder of tempered martensite may be obtained.

MODE FOR INVENTION

Hereinafter, the present disclosure will be described in more detail with reference to Example.

Example

After preparing each steel slab having composition components shown in Table 1 below, these steel slabs were reheated in a temperature range of 1050 to 1250° C. The reheated steel plate was hot-rolled at a reduction ratio of 5 to 30% per pass to manufacture hot-rolled steel plates, respectively. Then, after the hot-rolled steel plate thus manufactured was air-cooled, the air-cooled hot-rolled steel plate was subjected to heat treatment, intermediate heat treatment, and tempering under the conditions shown in Table 2 to manufacture a pressure vessel steel plate. In this case, the heat treatment time, intermediate heat treatment time, and tempering time were kept constant at 80 minutes for steel type a, 105 minutes for steel type b, and 140 minutes for steel type c.

The phase fractions of tempered bainite and retained austenite among the microstructures of the steel plate manufactured as described above were measured using an image analyzer, which was shown in Table 2 below. In this case, the measurement site of the steel plate is the t/4 point. In addition, yield strength, tensile strength, and lateral expansion characteristics were evaluated for the manufactured steel plates, and the results were shown in Table 2 below. Meanwhile, in Table 2 below, the lateral expansion characteristics show the results of evaluating the lateral expansion values obtained by performing a Charpy impact test on a specimen having a V-notch at −150° C. The tensile stress and the like show the results measured according to the tensile test standards ASTM A20 and ASTM E8.

TABLE 1

| Steel | Composition Component (wt %) | | | | | | | | | |
|---|---|---|---|---|---|---|---|---|---|---|
| Type | C | Mn | Si | P | S | Al | Ni | Mo | Pd | Remarks |
| A | 0.10 | 0.51 | 0.26 | 0.008 | 0.0010 | 0.035 | 4.95 | 0.28 | 0.05 | Inventive steel |
| B | 0.09 | 0.54 | 0.29 | 0.007 | 0.0012 | 0.030 | 4.85 | 0.27 | 0.07 | Inventive steel |

TABLE 1-continued

| Steel | Composition Component (wt %) | | | | | | | | | |
|---|---|---|---|---|---|---|---|---|---|---|
| Type | C | Mn | Si | P | S | Al | Ni | Mo | Pd | Remarks |
| C | 0.08 | 0.53 | 0.27 | 0.011 | 0.0011 | 0.028 | 4.85 | 0.29 | 0.08 | Inventive steel |
| D | 0.11 | 0.52 | 0.28 | 0.010 | 0.0010 | 0.031 | 4.60 | 0.25 | — | Comparative steel |

TABLE 2

| Steel type | Thickness (mm) | Rolling end temperature (° C.) | Heat treatment temperature (° C.) | Intermediate heat treatment temperature (° C.) | Tempering temperature (° C.) | Tempered bainite fraction (%) | Retained austenite fraction (%) | YS (MPa) | TS (MPa) | El (%) | Lateral expansion at −150° C. (mm) | Remarks |
|---|---|---|---|---|---|---|---|---|---|---|---|---|
| a | 20 | 850 | 880 | 740 | 630 | 62 | 3.5 | 657 | 721 | 36 | 2.31 | Inventive Example 1 |
| | | 860 | 900 | 730 | 640 | 60 | 3.8 | 655 | 720 | 38 | 2.28 | Inventive Example 2 |
| b | 35 | 850 | 880 | 750 | 630 | 63 | 4.1 | 653 | 723 | 35 | 2.43 | Inventive Example 3 |
| | | 860 | 900 | 740 | 640 | 59 | 3.9 | 659 | 719 | 36 | 2.31 | Inventive Example 4 |
| c | 50 | 850 | 880 | 730 | 630 | 58 | 3.8 | 653 | 728 | 38 | 2.45 | Inventive Example 5 |
| | | 850 | 900 | 740 | 640 | 55 | 4.0 | 657 | 724 | 39 | 2.15 | Inventive Example 6 |
| d | 25 | 850 | Air cooling | — | — | 0 | 0 | 555 | 620 | 24 | 0.45 | Comparative Example 1 |
| | | 850 | Air cooling | — | — | 0 | 0 | 549 | 619 | 25 | 0.48 | Comparative Example 2 |

As shown in Tables 1 and 2, in the case of Inventive Examples 1 to 6 in which the steel composition component and the manufacturing process conditions satisfy the scope of the present disclosure, it may be confirmed that after the tempering treatment, by area fraction, 15 to 80% of tempered bainite and a remainder of tempered martensite may be obtained. Therefore, it may be seen that the yield strength and tensile strength are superior by about 100 MPa, the elongation is also superior by 10% or more, and the low-temperature lateral expansion at −150° C. is also excellent by 1.5 mm or more compared to comparative materials 1 and 2.

As described above, exemplary embodiments of the present disclosure have been described in the detailed description of the present disclosure, but those of ordinary skill in the art to which the present disclosure pertains may be variously modified without departing from the scope of the present disclosure. Therefore, the scope of the present disclosure is not construed as being limited to the embodiments described above, but should be defined by the following claims as well as equivalents thereto.

The invention claimed is:

1. A steel plate for a low-temperature pressure vessel, the steel plate comprising:

by wt %, 0.05 to 0.15% of C, 0.20 to 0.40% of Si, 0.3 to 0.6% of Mn, 0.015% or less of P, 0.015% or less of S, 0.02 to 0.10% of Al, 2.5 to 5.5% of Ni, 0.2 to 0.4% of Mo, 0.05 to 0.15% of Pd, with a remainder of Fe and inevitable impurities, wherein a steel microstructure comprises, by area fraction, 0.5 to 5.0% of retained austenite, 25 to 85% of tempered bainite, and a remainder of tempered martensite.

2. The steel plate of claim 1, comprising 0.05 to 0.10% of Pd.

3. A method of manufacturing the steel plate of claim 1, the method comprising:

reheating steel slab containing, by wt %, 0.05 to 0.15% of C, 0.20 to 0.40% of Si, 0.3 to 0.6% of Mn, 0.015% or less of P, 0.015% or less of S, 0.02 to 0.10% of Al, 4.5 to 5.5% of Ni, 0.2 to 0.4% of Mo, 0.05 to 0.15% of Pd, with a remainder of Fe and inevitable impurities, at 1050 to 1250° C.;

performing a hot rolling process of manufacturing a hot-rolled steel plate by hot-rolling the reheated steel slab at a reduction ratio of 5 to 30% per pass and terminating the hot rolling at a temperature of 800° C. or higher; air-cooling the manufactured hot-rolled steel plate, heating the air-cooled steel plate in a temperature range of 850 to 920° C. for {2.4 xt+(10 to 30)} minutes [where t means a thickness (mm) of a steel], and then water-cooling the manufactured hot-rolled steel plate to 150° C. or lower;

performing an intermediate heat treatment for the water-cooled steel sheet at 690 to 760° C. for {2.4×t+(10 to 30)} minutes [where t is the thickness (mm) of the steel], and then water-cooling the water-cooled steel sheet to 150° C. or lower; and tempering the water-cooled steel sheet for {2.4×t+(10 to 30)} minutes [where t is the thickness (mm) of the steel] in a section of 600 to 660° C.

4. The method of claim 3, wherein the steel plate obtained in the tempering has a microstructure comprising, by area fraction, 0.5 to 5.0% of retained austenite, 25 to 85% of tempered bainite, and a remainder of tempered martensite.

* * * * *